US008696163B2

(12) United States Patent
Chen et al.

(10) Patent No.: US 8,696,163 B2
(45) Date of Patent: Apr. 15, 2014

(54) LAMP WITH WIDE-ANGLE LIGHT EMISSION AND BULB THEREOF

(75) Inventors: Wei-Jen Chen, Kaohsiung (TW); Kuo-Hao Huang, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 159 days.

(21) Appl. No.: 13/242,018

(22) Filed: Sep. 23, 2011

(65) Prior Publication Data

US 2013/0044491 A1 Feb. 21, 2013

(30) Foreign Application Priority Data

Aug. 18, 2011 (TW) ..... 100129568 A

(51) Int. Cl.
*F21V 14/00* (2006.01)

(52) U.S. Cl.
USPC ..... 362/255; 362/256; 362/363; 362/373

(58) Field of Classification Search
USPC ..... 362/255–256, 373, 294, 355, 361, 307, 362/363, 311.01–311.02
See application file for complete search history.

(56) References Cited

U.S. PATENT DOCUMENTS

| | | | | | |
|---|---|---|---|---|---|
| 1,778,305 | A * | 10/1930 | Blau | ..... | 362/350 |
| 2,102,462 | A * | 12/1937 | Howell | ..... | 362/305 |
| 3,067,352 | A * | 12/1962 | Vodicka et al. | ..... | 313/116 |
| 4,300,068 | A * | 11/1981 | Baird et al. | ..... | 313/315 |
| 2010/0002453 | A1 * | 1/2010 | Wu et al. | ..... | 362/373 |
| 2012/0155059 | A1 * | 6/2012 | Hoelen et al. | ..... | 362/84 |

FOREIGN PATENT DOCUMENTS

| | | |
|---|---|---|
| TW | 218249 | 12/1993 |
| TW | M372443 U1 | 1/2010 |
| TW | M394415 U1 | 12/2010 |

* cited by examiner

*Primary Examiner* — Robert May
(74) *Attorney, Agent, or Firm* — Alan Kamrath; Kamrath IP Lawfirm, P.A.

(57) ABSTRACT

A lamp with wide-angle light emission includes a housing, a light emitting module and a bulb. The housing has a coupling portion and an electrical connector formed at two ends thereof. The light emitting module is arranged at the coupling portion of the housing. The bulb covers the light emitting module and includes a center part and a border part, with the center part axially aligning with the light emitting module and the border part surrounding the center part. Furthermore, a diffusing reflector is arranged on the center part, and the border part is formed by a light transmitting portion.

7 Claims, 6 Drawing Sheets

LAMP WITH WIDE-ANGLE LIGHT EMISSION AND BULB THEREOF

BACKGROUND OF THE INVENTION

1. Field of the Invention

The present invention generally relates to a lamp with a wide-angle light emission and a bulb thereof and, more particularly, to a lamp emitting light over a wide angle using a diffusing reflector.

2. Description of the Related Art

Referring to FIG. 1, a conventional lamp 8 of Taiwan Patent Publication No. 218249 entitled "electric reflector lamp" has a reflector 81 with a light emitter 82 inside. There is a bulb 83 made of a glass cap and mounted on an end of the reflector 81 for the light emitted by the light emitter 82 to be transmitted outside the reflector 81 via the bulb 83.

However, the bulb 83 of this conventional lamp 8 is unable to diffuse or reflect the light passing through the bulb 83, and, thus, most parts of the light emitted by the light emitter 82 can only be transmitted in a forward way shown as the arrows in FIG. 1 without radiating in other directions. Therefore, an angle illumination range of this conventional lamp 8 is limited and can not be enhanced.

There are some lamps that have "white reflection films" inside the lamps to enhance the illumination efficiency thereof, such as those disclosed by Taiwan Patent No. M372443 with a title of "LED illumination device" and by Taiwan Patent No. M394415 with a title of "enhanced LED illumination device."

However, these lamps with white reflection films only transfer the direct and sharp light emitted by LED light emitters of the lamps into soft light by the white reflection films, and emitted light over a wide angle is still unachievable. In light of this, it is desired to improve the conventional lamps.

SUMMARY OF THE INVENTION

It is therefore the primary objective of this invention to provide a lamp with wide-angle light emission that emits light in various directions to have a wide illumination angle.

It is therefore another objective of this invention to provide a bulb of lamp with wide-angle light emission, with the light passing through the bulb diffused previously to have a wide illumination angle.

The invention discloses a lamp with wide-angle light emission comprising a housing, a light emitting module and a bulb. The housing has a coupling portion and an electrical connector formed at two ends thereof. The light emitting module is arranged at the coupling portion of the housing. The bulb covers the light emitting module and comprises a center part and a border part, with the center part axially aligning with the light emitting module and the border part surrounding the center part. Furthermore, a diffusing reflector is arranged on the center part, and the border part is formed by a light transmitting portion.

The invention further discloses that 5-50% of an outer surface or an inner surface of the bulb is covered by the diffusing reflector.

The invention further discloses that a fan module is mounted inside the housing via the coupling portion of the housing, and the light emitting module and the bulb are mounted on the fan module.

The invention further discloses that an inner surface of the housing adjacent to the coupling portion acts as a wind guiding wall, with an air channel formed between the fan module and the wind guiding wall of the housing.

The invention further discloses that the fan module includes a heat sink and a cooling fan, that the cooling fan is mounted on the heat sink, and that the light emitting module and the bulb are mounted on the heat sink.

The invention further discloses that the diffusing reflector is a white diffusion reflector of a plate, a coating or a film, with the white diffusion reflector plate, coating or film mounted on an outer side or an inner side of the center part of the bulb.

The invention further discloses that an auxiliary diffusing reflector is mounted on the light emitting module and faces the center part of the bulb.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
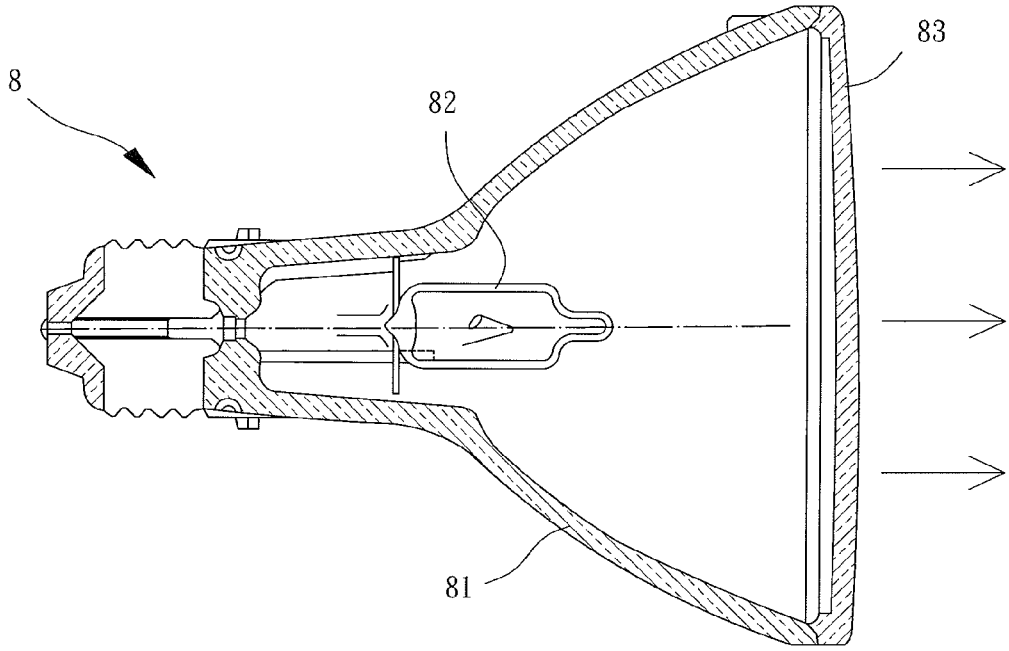
FIG. 1 PRIOR ART
FIG. 1 shows a cross-sectional view of a conventional lamp.

In the various figures of the drawings, the same numerals designate the same or similar parts. Furthermore, when the terms "inner," "outer," and similar terms are used hereinafter, it should be understood that these terms refer only to the structure shown in the drawings as it would appear to a person viewing the drawings, and are utilized only to facilitate describing the invention.

DETAILED DESCRIPTION OF THE INVENTION

Figure 2:
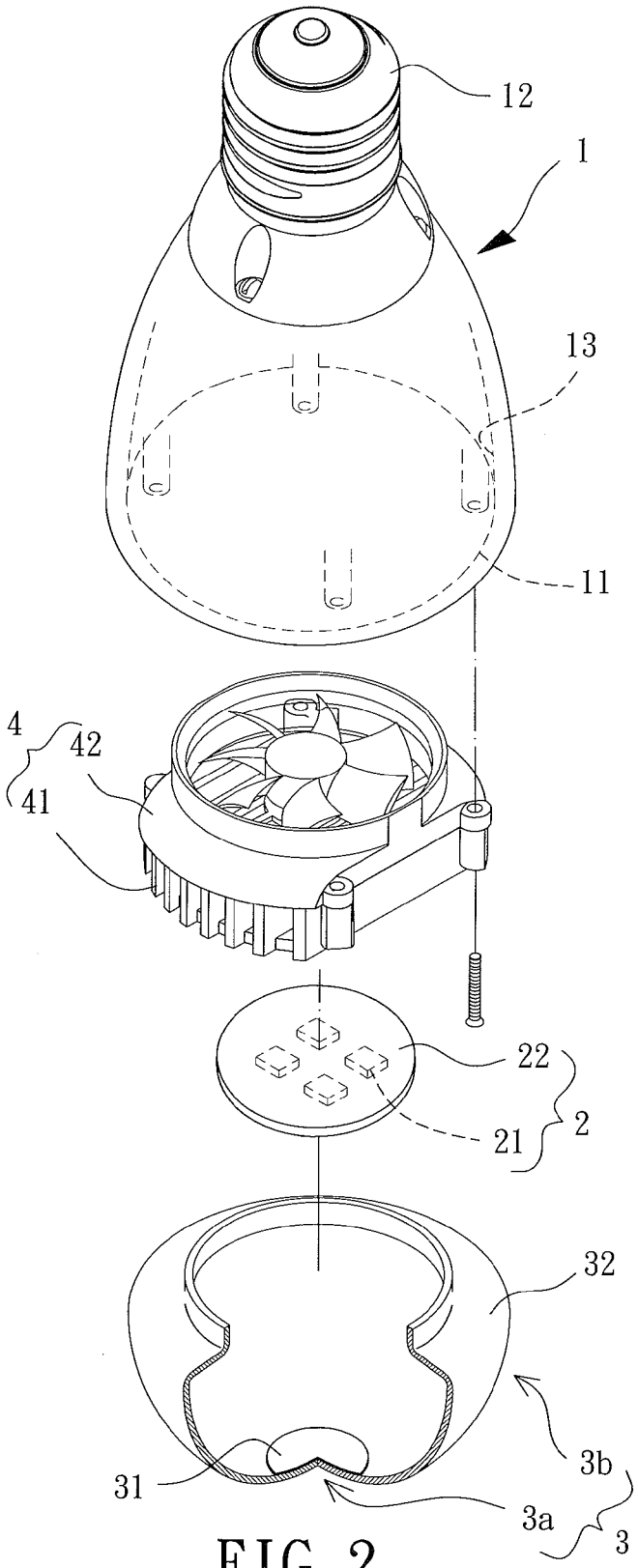
FIG. 2 shows an exploded perspective view of a lamp with wide-angle light emission according to a preferable embodiment of the invention.
Figure 3A:
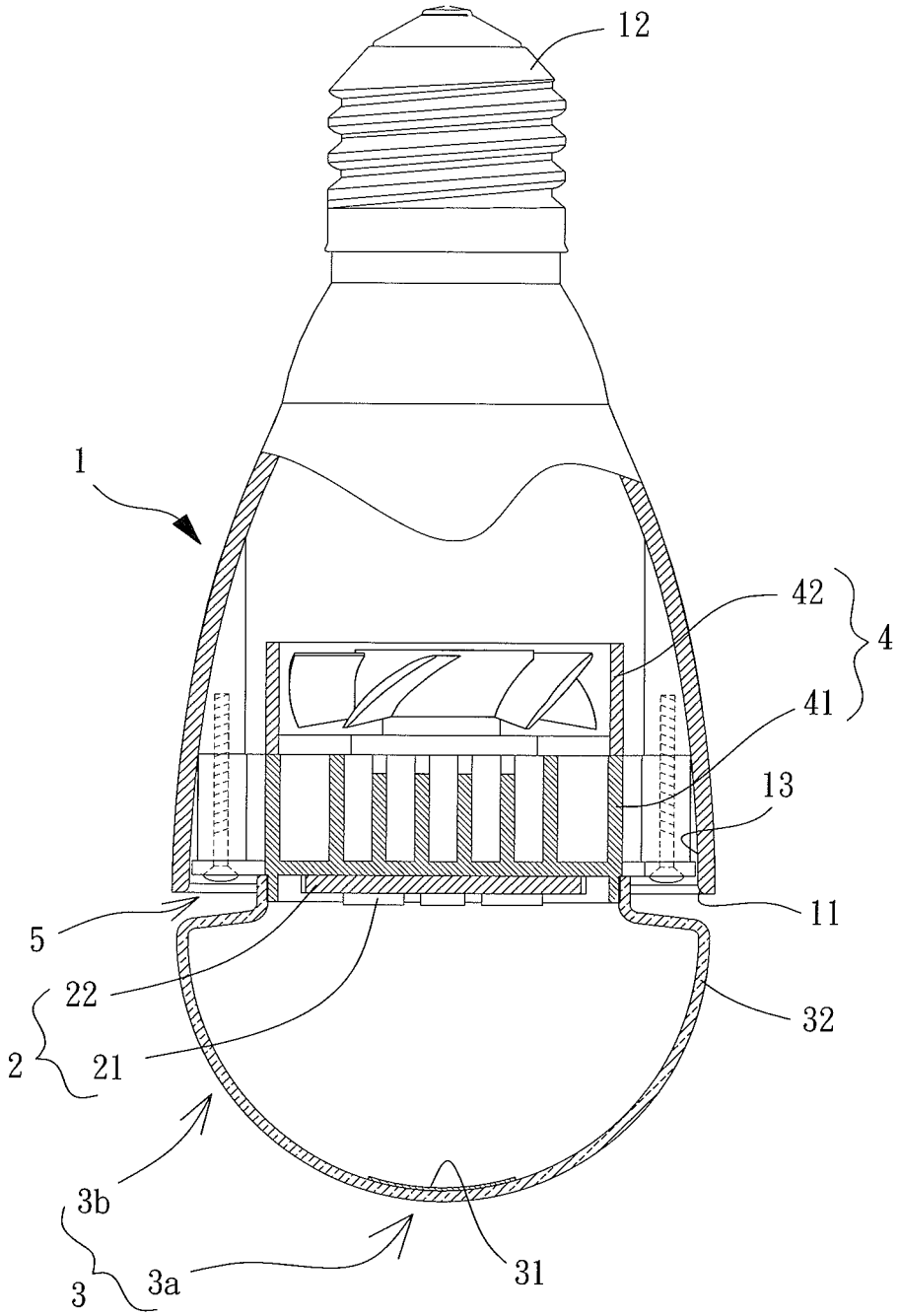
FIG. 3*a* shows a cross-sectional view of the lamp with wide-angle light emission with a diffusing reflector arranged on an inner side of a bulb.

Referring to FIGS. 2 and 3*a*, a preferable embodiment of the present invention including a housing 1, a light emitting module 2 and a bulb 3 is shown. The housing 1 is utilized for the light emitting module 2 to engage with, the light emitting module 2 is received in the housing 1, and the bulb 3 is mounted to an end of the housing 1 for the light emitted by the light emitting module 2 to be transmitted outside the housing 1 via the bulb 3.

The housing 1 is a hollow casing, with a coupling portion 11 and a electrical connector 12 formed at two ends of the housing 1. The, coupling portion 11 is preferably an opening communicating with an inner chamber of the housing 1 for the light emitting module 2 to be received in the inner chamber via the coupling portion 11, and the electrical connector 12 is in a form able to electrically connect with an external electrical power as a power source of the present lamp.

The light emitting module 2 is arranged inside the housing 1 at the coupling portion 11 and electrically connects with the electrical connector 12, while the way in which the light emitting module 2 arranged in the housing 1 is screwing, hooking, adhering or welding. In this embodiment, the light emitting module 2 is adhered to a fan module 4 mounted inside the housing 1 by screwing. The light emitting module 2 includes a plurality of light elements 21 capable of emitting light such as LEDs and a base 22 electrically connecting with the light elements 21 and the electrical connector 12 of the housing 1 for controlling the light elements 21. Preferably, the light elements 21 are LEDs for effects of long lifetime and power saving.

Figure 3B:
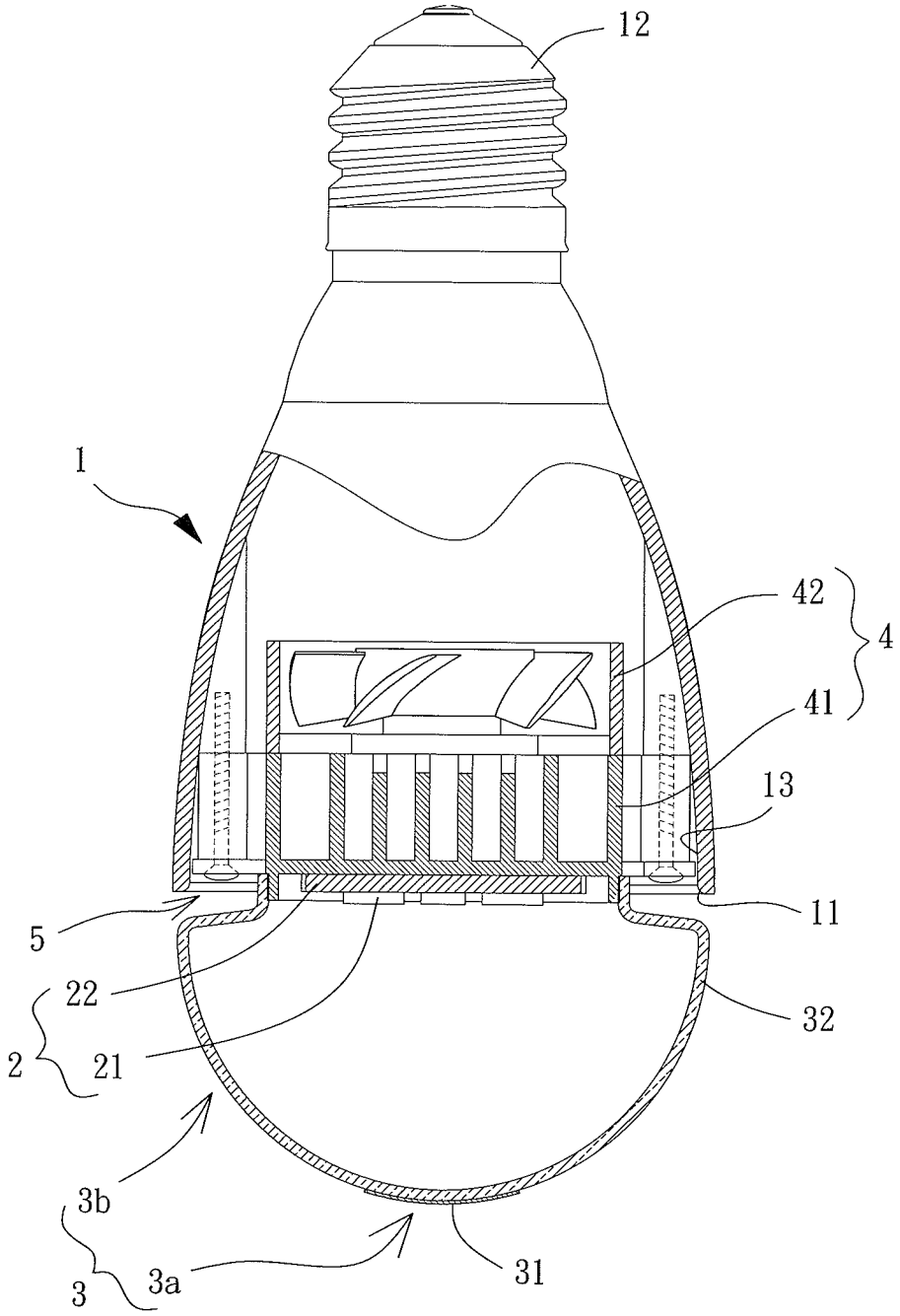
FIG. 3*b* shows a cross-sectional view of the lamp with wide-angle light emission with a diffusing reflector arranged on an outer side of a bulb.

The bulb 3 extends to the coupling portion 11 of the housing 1 and covers the light emitting module 2, and the way in which the bulb 3 arranged at the coupling portion 11 can also be screwing, hooking, adhering or welding. In this embodiment, the bulb 3 also mounts on the housing through the fan module 4. In detail, the bulb 3 includes a center part 3*a* and a border part 3*b*, with the center part 3*a* axially aligning with the light emitting module 2 and the border part 3*b* surrounding the center part 3*a*. There is a diffusing reflector 31 arranged on the center part 3*a*, which has a structure capable of reflecting light with a diffusion effect. For example, the diffusing reflector 31 is a white diffusion reflector of a plate, a coating or a film, with this white diffusion reflector plate, coating or film mounted on the inner or outer side of the center part 3*a* of the bulb 3. The space inside the bulb 3 is saved when the diffusing reflector 31 is mounted on the outer side of the center part 3*a* as shown in FIG. 3*b*, and the diffusing reflector 31 may be kept away from dust or contaminants by the bulb 3 to maintain its performance in reflection when the diffusing reflector 31 is mounted on the inner side of the center part 3*a*. The border part 3*b* of the bulb 3 is formed by a light transmitting portion 32 for light directly emitted by the light elements 21 and diffusion light reflected by the diffusing reflector 31 to pass through toward the outside of the bulb 3.

The fan module 4 further included in this lamp is for lowering the operating temperature of the light emitting module 2 attached thereto, to provide a preferable cooling performance. In detail, the fan module 4 is mounted inside the housing 1 via the coupling portion 11 of the housing 1. The inner surface of the housing 1 adjacent to the coupling portion 11 acts as a wind guiding wall 13, with an air channel 5 formed between the fan module 4 and the wind guiding wall 13 of the housing 1 as an air inlet or an air outlet. The fan module 4 can be mounted inside the housing 1 by screwing, hooking, adhering or welding, and the way shown in FIG. 2 for mounting the fan module 4 in the housing 1 is fastening the fan module 4 and a positioning support of the housing 1 by screws.

In this embodiment, the fan module 4 includes a heat sink 41 and a cooling fan 42. The heat sink 41 is made of heat-conducting material, and the cooling fan 42, which is an axial fan preferably or is a blower, is mounted on the heat sink 41. Accordingly, the heat sink 41 and the cooling fan 42 may provide the light emitting module 2 with a desirable cooling efficiency. Furthermore, the air channel 5 formed between the fan module 4 and the wind guiding wall 13 of the housing 1 can be formed between the heat sink 41 and the wind guiding wall 13 or between the cooling fan 42 and the wind guiding wall 13. Besides, referring to FIG. 3, positions of the light emitting module 2 and the bulb 3 relative to the coupling portion 11 of the housing 1 are firm, since the fan module 4 is firmly mounted inside the housing 1.

Figure 4:
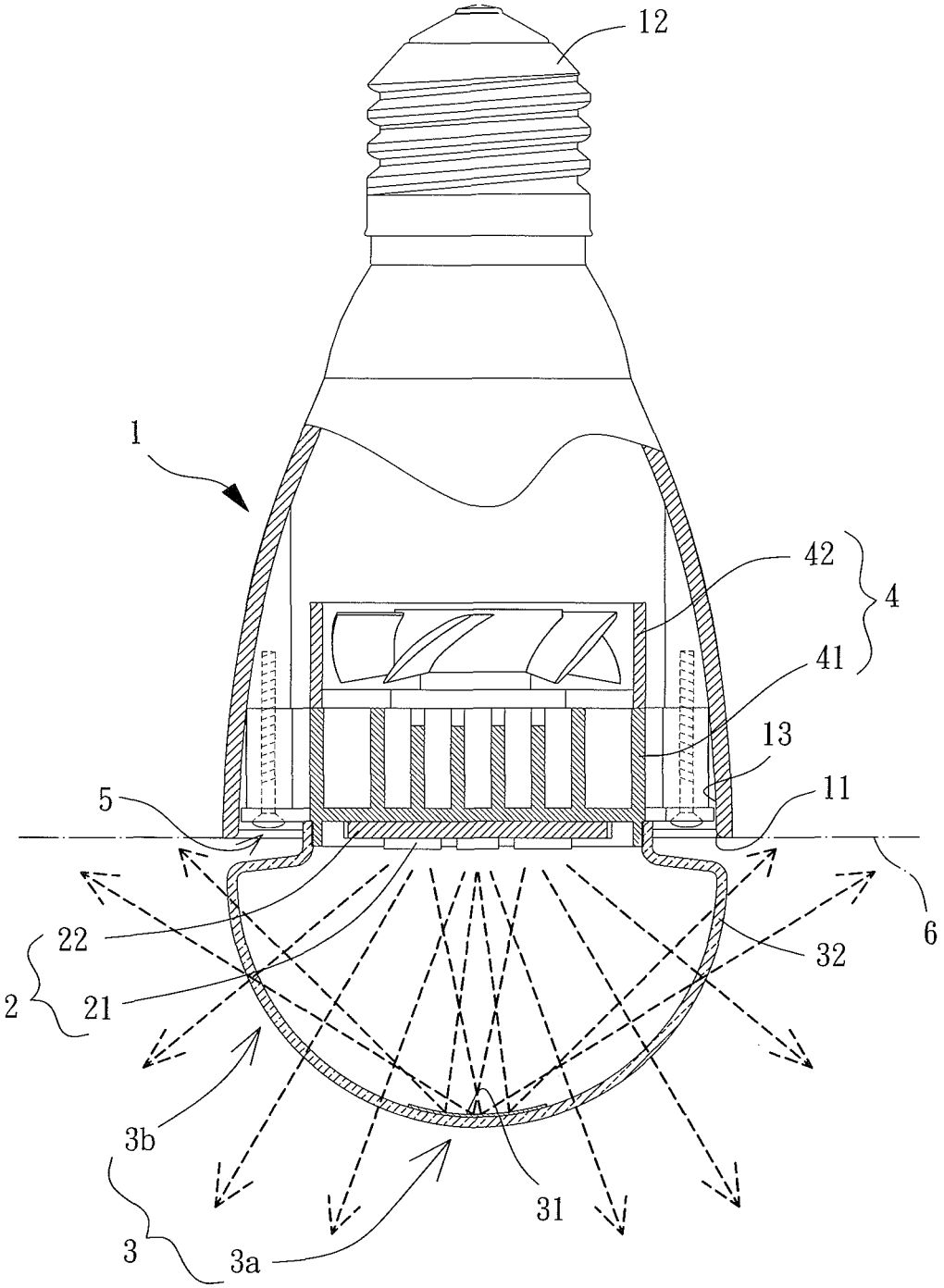
FIG. 4 shows a cross-sectional view of the lamp with wide-angle light emission in use.

Referring to FIG. 4, when the lamp of the invention is in use, the lamp can be installed in places where illumination is required, such as wall, ceiling and so on. As an example, the housing 1 of the lamp can be partially inserted into the decorative ceiling 6 in a way that the coupling portion 11 of the housing 1, the light emitting module 2 and the bulb 3 are located outside the confined space and beneath the decorative ceiling 6, and an end of the air channel 5 is also beneath the decorative ceiling 6. When the present lamp is provided with electrical power through the electrical connector 12 of the housing 1 for the light emitting module 2 to operate and for the cooling fan 42 of the fan module 4 to rotate, the light emitting module 2 can emit light, and the air channel 5 can inhale or expel air to dissipate heat generated by the light emitting module 2.

Referring to FIG. 4 again, with the above-illustrated features, the characters of the present lamp lie in that the light emitted by the light emitting module 2 is firstly transmitted to the diffusing reflector 31, since the center part 3*a* where the diffusing reflector 31 is arranged axially aligns with the light emitting module 2 and the light reflected by the diffusing reflector 31 may pass through the light transmitting portion 32 toward the outside of the bulb 3 due to the diffusion effect of the diffusing reflector 31 and the surrounding arrangement of the light transmitting portion 32 relative to the diffusing reflector 31. Therefore, light can also be emitted out of the present lamp in edge sections of the bulb 3 that are adjacent to the housing 1, which are unreachable for the light emitted by the conventional lamps. Thus, the present lamp has an illumination range in angle wider than that of the conventional lamps.

Particularly, although the light emitted by the light emitting module 2 can not pass through the diffusing reflector 31, the illumination effect of the present lamp is desirable, since the diffusing reflector 31 is arranged on the center part 3*a* and since only a few parts of the bulb 3 are thus impassable for light, while the light reflected by the diffusing reflector 31 can be transmitted in many more directions. Moreover, it is preferable that 5-50% of the outer surface or inner surface of the bulb 3 is covered by the diffusing reflector 31.

Figure 5:
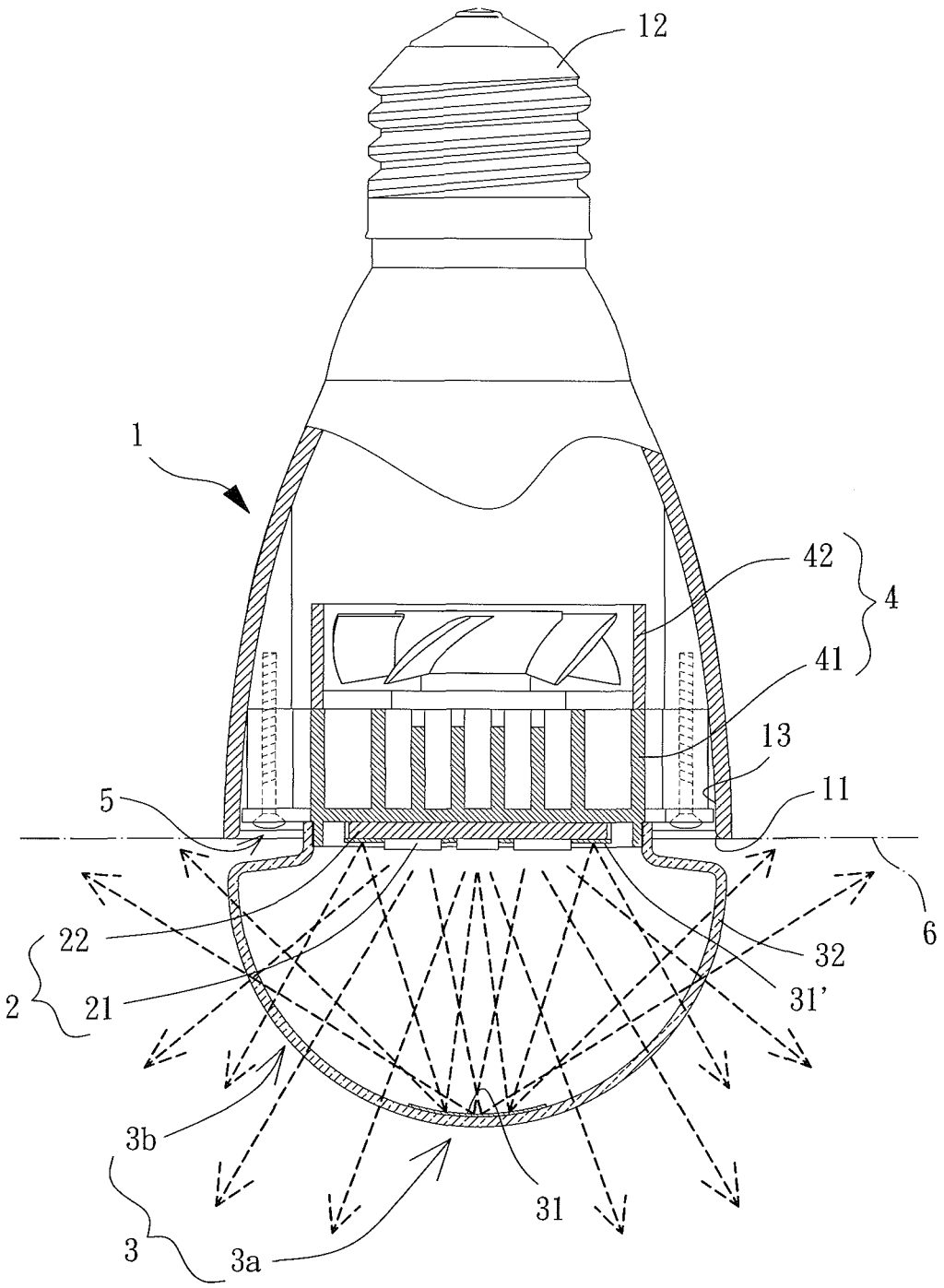
FIG. 5 shows a cross-sectional view of the lamp with wide-angle light emission having an auxiliary diffusing reflector.

Please further refer to FIG. 5. There can be an auxiliary diffusing reflector 31' mounted on the light emitting module 2, with the auxiliary diffusing reflector 31' facing the center part 3*a* of the bulb 3 and preferably adjacent to the light elements 21 of the light emitting module 2. With the arrangement of the auxiliary diffusing reflector 31', the light reflected by the diffusing reflector 31 can be reflected again by the auxiliary diffusing reflector 31, to further enlarge illumination range in angle.

In sum, because the diffusing reflector 31 faces the light emitting module 2 and the light transmitting portion 32 surrounds the diffusing reflector 31, the light emitted by the light emitting module 2 can be transmitted in many more directions to have a wide illumination angle, to improve an illumination effect.

Moreover, since the diffusing reflector 31 on the center part 3*a* and since the light transmitting portion 32 forming the border part 3*b* are provided at the same time, the light passing through the bulb 3 is diffused previously to have a wide illumination angle.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A lamp with wide-angle light emission, comprising:

a housing having a coupling portion and an electrical connector formed at two ends thereof;

a light emitting module arranged at the coupling portion of the housing;

a bulb extending to the coupling portion of the housing and enclosing the light emitting module, with the bulb comprising a center part and a border part, with the center part axially aligning with the light emitting module and with the border part extending outwards from an outer periphery of the center part to the coupling portion and surrounding the center part;

diffusing reflector impermeable to light and arranged on the center part, wherein the border part is formed by a light transmitting portion; and an auxiliary diffusing reflector mounted on the light emitting module and facing the center part of the bulb.

2. The lamp with wide-angle light emission as claimed in claim 1, wherein 5-50% of an outer surface or an inner surface of the bulb is covered by the diffusing reflector.

3. The lamp with wide-angle light emission as claimed in claim 1 further comprising a fan module, wherein the fan module is mounted inside the housing via the coupling portion of the housing, and wherein the light emitting module and the bulb are mounted on the fan module.

4. The lamp with wide-angle light emission as claimed in claim 3, wherein an inner surface of the housing adjacent to the coupling portion acts as a wind guiding wall, with an air channel formed between the fan module and the wind guiding wall of the housing.

5. The lamp with wide-angle light emission as claimed in claim 3, wherein the fan module includes a heat sink and a cooling fan, wherein the cooling fan is mounted on the heat sink, and wherein the light emitting module and the bulb are mounted on the heat sink.

6. The lamp with wide-angle light emission as claimed in claim 1, wherein the diffusing reflector is a white diffusion reflector of a plate, a coating or a film, with the white diffusion reflector plate, coating or film mounted on an outer side of the center part of the bulb.

7. The lamp with wide-angle light emission as claimed in claim 1, wherein the diffusing reflector is a white diffusion reflector of a plate, a coating or a film, with the white diffusion reflector plate, coating or film is mounted on an inner side of the center part of the bulb.

* * * * *